US006235184B1

(12) United States Patent
De Carvalho et al.

(10) Patent No.: US 6,235,184 B1
(45) Date of Patent: May 22, 2001

(54) ANODE, A PROCESS FOR THE MANUFACTURE THEREOF AND A PROCESS FOR THE PRODUCTION OF ALUMINUM

(75) Inventors: José Ricardo Duarte De Carvalho, Belém-Pará; Eduardo Baptista Sarcinelli; Deusa Maria Braga Dognini, both of Barcarena-Pará, all of (BR)

(73) Assignee: Albras Aluminio Brasileiro S.A., Barcarera-PA-Brazil ( * ) Notice: Subject to any disclaimer, the term of this patent is extended or adjusted under 35 U.S.C. 154(b) by 0 days.

(21) Appl. No.: 09/123,610

(22) Filed: Jul. 28, 1998

(30) Foreign Application Priority Data

Apr. 17, 1998 (BR) ..... 9800469
Aug. 6, 1998 (BR) ..... 9705537

(51) Int. Cl.[7] ..... C25C 3/06; C25C 3/12; C25B 11/12; H05B 7/107; H01B 1/06

(52) U.S. Cl. ..... 205/372; 204/294; 252/510; 373/97

(58) Field of Search ..... 204/280, 294, 204/291, 292; 252/510; 205/372; 373/97

(56) References Cited

U.S. PATENT DOCUMENTS

| | | | | |
|---|---|---|---|---|
| 3,787,310 | * | 1/1974 | Johnson | 204/294 X |
| 4,192,730 | * | 3/1980 | Dumas et al. | 204/294 |
| 5,145,570 | * | 9/1992 | Jusufbegovic | 204/279 |
| 5,527,518 | * | 6/1996 | Lynum et al. | 423/449.1 |
| 5,932,086 | * | 8/1999 | Kasaaian | 205/573 |

* cited by examiner

*Primary Examiner*—Donald R. Valentine
(74) *Attorney, Agent, or Firm*—Helfgott & Karas, P O.

(57) ABSTRACT

The present invention refers to an anode composition comprising as binding agent the sugar cane molasses instead of the conventional electrolytic pitch. The composition may optionally include additives based on lithium, fluorine, aluminum, boron and sulfur, and is used in a process for the manufacture of anodes for the primary aluminum industry. The invention also refers to a process for the manufacture of said anode and the application thereof to the primary aluminum industry.

21 Claims, No Drawings

ANODE, A PROCESS FOR THE MANUFACTURE THEREOF AND A PROCESS FOR THE PRODUCTION OF ALUMINUM

FIELD OF THE INVENTION

The present invention refers to a new material for the manufacture of anodes used in the processes for the electrolytic production of primary aluminum.

More specifically, the present invention refers to a new type of anode which composition comprises sugar cane molasses as binding agent.

Therefore, the present invention refers to the replacement of electrolytic pitch usually employed in conventional anode manufacturing processes for the primary aluminum industry. The electrolytic pitch is replaced by sugar cane molasses either pure or provided with additives.

BACKGROUND OF THE INVENTION

The aluminum industry techniques have been known for more than a century in all the aluminum plants all over the world such as, for example, the Hall-Heroult process. Such premises usually incorporate attached thereto what we know as anode plants which are essential elements in this kind of industry.

The process for manufacturing anodes presently in use comprises the production of a mixture of petroleum coke with residual reduction anodes known as butts, and electrolytic pitch which is obtained from the tar. The first two ingredients, that is, petroleum coke and residual reduction anodes are submitted to crushing, sieving and classifying operations in specific granulometric fractions in such a way that after they are mixed, they may produce the highest "packing" degree that can be attained for the purpose of using as little binding agent and obtaining the best mechanical properties for the anode.

All the above mentioned fractions are heated and subsequently mixed to the electrolytic pitch. This operation is carried out in continuous or batch mixers by using temperature range from 80° C. to 350° C. depending on the process used.

The result of the mixing step described above is a slurry which may be directly used in the electrolytic reduction vats when the aluminum is produced through Soderberg process, for producing the required anode for the reduction process. Said anode is produced by baking said slurry in the heat of the reduction vats which operate at temperature from 900° C. to 1,000° C.

Alternatively, said slurry may also be pressed or compacted or vibrocompacted in suitable presses or compactors, with or without vacuum, in order to produce green anodes which are usually designed to be used in the process known as pre-baked process.

However, before being used in the pre-baked reduction process, said green anodes should be submitted to baking in special furnaces which may be open or closed. In such furnaces, the green anodes are baked within a temperature range from 900° C. to 1,200° C. in order to attain the required physical and chemical properties to be used in furnaces for reducing alumna to primary aluminum.

It is also known by those skilled in the art that during the process for the preparation of the above-mentioned anodic slurry for the Soderberg process, as well as during the process for baking the green anodes for the pre-baked process, aromatic components are released from the electrolytic pitch and despite the fact that they are below the limits set out by the regulations of a number of countries they are deleterious either by inhalation or contact and the result is a noxious environment.

Another typical inconvenience from the use of electrolytic pitch is that since it is in the solid form dust is generated and often the plant operators get burned by exposing the skin in contact with the dust under the sun. Said burns are deemed as quite severe.

Another inconvenience in the use of solid electrolytic pitch is related to the dirty caused in the plant area and the frequent problems at navigation ports when handling the electrolytic pitch which is usually transported by ships.

Trying to minimize the above-mentioned inconveniences, systems based on the gas treatment in association or not with efficient dust removing systems have been used. Also to minimize said inconveniences it has been tried to replace solid electrolytic pitch by liquid electrolytic pitch. However, such resources are not fully efficient and demand very high investment costs.

OBJECTS OF THE INVENTION

Therefore, an object of the present invention is to provide a new anode material to be used in processes for the electrolytic production of primary aluminum which material shall not bring about an insalubrious environment during the process for the preparation of the anodic slurry and/or during the baking process.

Another object of the present invention is to provide a new anode material to be used in processes for the electrolytic production of primary aluminum which production process should not produce dirt in the plant area as well as overcome the frequent problems of handling the raw material for manufacturing said anodes found in navigation ports.

Another object of the present invention is to provide a new anode material to be used in processes for the electrolytic production of primary aluminum which material should not cause any damage to the health of operators.

Another object of the present invention is to provide a new anode material to be used in processes for the electrolytic production of primary aluminum which process should not be aggressive to the environment close to the producing process area.

Still another object of the present invention is to provide a process for the electrolytic production of primary aluminum which does not require sophisticated gas treatment systems and/or dust removing systems in the anode plants, so that the accomplishment of the process as a whole may be cost-effective.

DETAILED DESCRIPTION OF THE INVENTION

These and other objects and advantages of the present invention are accomplished by using sugar cane molasses, either pure or provided with additives, as the binding agent in the manufacture of anodes used in processes for the electrolytic production of primary aluminum.

Said sugar cane molasses, either pure or provided with additives, is used instead of the traditional solid or liquid electrolytic pitch.

Within the scope of the present invention, "sugar cane molasses" should mean the main honey (syrup) for producing molasses or the sugar production waste.

As additives in the present invention, mention could be made to substances based on lithium, fluorine, alumina, boron, sulfur and the mixtures thereof, provided that such additives do not have properties and performance similar or close to those shown by anodes produced from electrolytic pitch The technique for using sugar cane molasses as binding agent for making the slurry and the green anode according to the present invention is similar to that of traditional processes for producing electrolytic pitch-based anodes which is widely known in the aluminum industry. However, the coke, the butt and the sugar cane molasses content is variable in addition to other conditions of the process such as the mixture temperature, the baking temperature and the tine which vary according to the type of coke, molasses itself, additives and/or the required properties for the anode to be produced.

Thus, the composition of the anode according to the present invention comprises about 50 to 70% by weight of petroleum coke, from 15 to 30% by weight of butt and 15 to 25% by weight of sugar cane molasses.

Preferably, the percentage of sugar cane molasses used in the anode composition according to the present invention is about 18% by weight based on the total composition weight.

Alternatively, according to the present invention the additives, the substances based on lithium, fluorine, aluminum, alumina, boron, sulfur and the mixtures thereof may be included in percentages varying from about 0 to 10% by weight.

According to the present invention, the process for manufacturing anode comprises the preparation of a mixture containing petroleum coke, residual reduction anodes and sugar cane molasses. The petroleum coke and the residual anodes are crushed, sieved and classified in specific granulometric fractions. The granulometric fractions thus obtained are heated and mixed with the sugar cane molasses in continuous or batch mixers at temperature ranging from 100° C. to 250° C. Preferably, the temperature is approximately 155° C. The mixing time shall depend on the type and capacity of the mixing equipment used in the process.

The product of this mixing is a slurry which may be either directly used in electrolytic reduction vats or pressed or compacted or vibrocompacted in proper presses or compactors, with or without vacuum, in order to produce green anode.

Said green anodes may then be submitted to baking in special furnaces at temperature ranging from 800° C. to 1,300° C. for a time ranging from 70 to 200 hours. Preferably, the baking temperature is about 1,100° C.

The slurry obtained as above-cited may be directly used in the Soderberg process, while the green anodes may be used in the pre-baked process after have been baked.

According to the present invention the typical composition of the sugar cane molasses to be used in the composition of anode have preferably the characteristics given on Table I below that may occur individual or simultaneously.

TABLE I

| PARAMETER | RANGE | UNIT |
|---|---|---|
| Refractometric Brix | 75–83 | % |
| Pol | 37–63 | % |
| Purity | 50–75 | % |
| Reducing sugars | 3–10 | % |
| Conductive ashes | 6–10 | % |

TABLE I-continued

| PARAMETER | RANGE | UNIT |
|---|---|---|
| IMPURITIES: | | |
| Iron | 200 max. | ppm |
| Silicon | 250 max. | ppm |
| Nickel | traces | |
| Vanadium | 150 max. | ppm |
| Calcium | 200 max. | ppm |
| Sodium | 100 max. | ppm |

ppm = parts per million
max. = maximum
Pol = sucrose content

According to the present invention, the typical composition of the petroleum coke to be used in the anode composition preferably has the characteristics given on Table II below that may occur individual or simultaneously.

TABLE II

| PARAMETER | RANGE | UNIT |
|---|---|---|
| Apparent density | 0.8–0.9 | $g/cm^3$ |
| Real density | 1.9–2.1 | $g/cm^3$ |
| Volatiles | 0.1–0.5 | % |
| Ashes | 0.1–0.6 | % |
| Humidity | 0–0.3 | % |
| IMPURITIES: | | |
| Iron | 400 max. | ppm |
| Silicon | 300 max. | ppm |
| Nickel | 300 max. | |
| Vanadium | 400 max. | ppm |
| Sodium | 200 max. | ppm |
| Calcium | 300 max. | ppm |
| Sulfur | 3.0 max. | % |

ppm = parts per million
max. = maximum

The following example shows the conditions of a preferred embodiment of the present invention. However, said example should not be deemed as limitation of the scope and conditions herein described above and claimed.

EXAMPLE

Comparative laboratory tests were performed in order to attain the best parameters possible to be used as reference for the industrial process for producing pre-baked anodes for the primary aluminum industry. The conditions of the anode composition and the process for the manufacture thereof were modified according to the experiments. The experiments were conducted in a bench scale equipment available by R.D.C. 5 kg of slurry were produced in each experiment which is equivalent to the manufacture of 14 anodes weighing 340 g each one.

The average composition of the sugar cane molasses used in the anode composition in the experiments is as follows:

Purity: 41.3%

Refractometric Brix: 78.3%

Pol: 32.3%

Reducing sugars: 32.4%

The process features leading to the best results are the following:

Sugar cane molasses concentration: 18%–20%

Mixing temperature: 135° C.–155° C.

Baking temperature: 1,100° C.

The anodes of the present invention were compared to conventional anodes using electrolytic pitch as binding agent. The results are given on Table III below.

TABLE III

| PARAMETER | INVENTION (molasses) 18% ST = 4 h | 18% ST = 20 h | 20% ST = 20 h | CONV. (pitch) 14,5% ST = 20 h |
|---|---|---|---|---|
| Apparent density (GA); g/cm$^3$ | 1.583 | 1.607 | 1.610 | 1.577 |
| Apparent density (BA); g/cm$^3$ | 1.442 | 1.446 | 1.471 | 1.530 |
| Real density; g/cm$^3$ | 2.093 | 2.089 | 2.090 | 2.125 |
| Mechanical strength; kgf/cm$^2$ | 318 | 224 | 209 | 263 |
| Electrical resistivity; $\mu$.ohm.cm | 8.583 | 8.738 | 7.541 | 7.995 |
| Air permeability, nPm | 1.563 | 1.582 | 1.401 | 1.982 |
| Thermal conductivity; w/m° K. | 2.12 | 2.16 | 2.10 | 2.1 |
| Residual air resistivity; % | 55.7 | 69.5 | 68.9 | 71.6 |
| Residual $CO_2$ reactivity; % | 58.2 | 57.5 | 65.4 | 81.5 |

ST = soaking time at the baking temperature; in hours
GA = green anode
BA = baked anode According to the data above, it can be seen that the characteristics of the anode according to the present invention are similar to those pattern for this kind of electrode containing pitch. In addition, a great advancement in the properties of subsequent tests that integrate the optimization research of the present invention could be seen.

Therefore, as can be seen in the description above, since the sugar cane molasses is a natural product and by applying the inventive anode and process for producing aluminum, all the above-mentioned problems related to the health of people and the environment caused by the use of electrolytic pitch are now definitively eliminated from the aluminum industry, besides avoiding the costs required for the implementation, operation and maintenance of gas and dust treatment systems in anode plants.

What is claimed is:

1. An anode or Söderberg slurry utilized in electrolytic cells for producing primary aluminum wherein a sugar is utilized as a pre-bake coalescing agent for the production of anodes for primary aluminum and said sugar includes at least one element or characteristic listed in the table below

| PARAMETER | RANGE | UNIT |
|---|---|---|
| Refractometric Brix | 75–83 | % |
| Pol | 37–63 | % |
| Purity | 50–75 | % |
| Reducing sugars | 3–10 | % |
| Conductive ashes | 6–10 | % |
| IMPURITIES: | | |
| Iron | 200 max. | ppm |
| Silicon | 250 max. | ppm |

-continued

| PARAMETER | RANGE | UNIT |
|---|---|---|
| Nickel | traces | |
| Vanadium | 150 max. | ppm |
| Calcium | 200 max. | ppm |
| Sodium | 100 max. | ppm. |

2. The anode or Söderberg slurry according to claim 1 comprising a composition of approximately 50 to 70% by weight of petroleum coke, 15 to 30% by weight of anode butts and 15 to 25% of said sugar.

3. The anode or Söderberg slurry according to claim 2 comprising additives of at least lithium, fluorine, aluminum, alumina, boron, or sulfur.

4. The anode or Söderberg slurry according to claim 3 wherein the additive content is approximately 0 to 10% by weight.

5. The anode or Söderberg slurry according to claim 2 wherein the petroleum coke has an apparent density of about 0.8 to 0.9 g/cm$^3$, a real density of about 1.9 to 2.1 g/cm$^3$, a volatiles content of about 0.1 to 0.5%, an ashes content of about 0.1 to 0.6%.

6. The anode or Söderberg slurry according to claim 2 wherein the petroleum coke shows a maximum content of impurities such as iron, silicon, nickel, vanadium, sodium, and calcium of about 500 ppm, and a sulfur content of about 3.0%.

7. The anode or Söderberg slurry according to claim 1 comprising additives of at least lithium, fluorine, aluminum, alumina, boron or sulfur.

8. The anode or Söderberg slurry according to claim 1 wherein the coalescing agent shows a refractometric brix of about 75 to 83%, a Pol of about 30 to 63%, a purity of about 40 to 75%, reducing sugars of about 3 to 35%, and conductive ash of about 6 to 10%.

9. The anode or Söderberg slurry according to claim 1 wherein the coalescing agent shows a refractive brix of about 76 to 83%, a Pol of about 37 to 63%, a purity of about 50 to 75%, reducing sugars of about 3 to 10%, and conductive ash of about 6 to 10%.

10. The anode or Söderberg slurry according to claim 1 wherein the coalescing agent shows a maximum content of impurities such as iron, silicone, nickel, vanadium, sodium, and calcium of about 400 ppm.

11. A process for the manufacture of an anode comprising the steps of:

preparing a pre-bake mixture containing petroleum coke, residual reduction anode, anode butts and sugar cane molasses;

crushing, sieving and classifying of petroleum coke and anode butts; and heating of classified fractions in a mixture with sugar cane molasses at temperature ranging from 100° C. to 250° C.

12. The process for the manufacture of an anode according to claim 11 wherein the mixture heating temperature is about 155° C.

13. The process for the manufacture of an anode according to claim 11 wherein the product of said heated mixture is a slurry which may be directly utilized in electrolytic reduction vats or may be pressed, compacted or vibrocompacted in proper presses or compactors, with or without vacuum, in order to produce green anodes.

14. The process for the manufacture of an anode according to claim 13 wherein said green anodes are subjected to baking in special furnaces of a temperature ranging from 800° C. to 1,300° C.

15. The process for the manufacture of an anode according to claim 13 wherein said green anodes are baked for a time ranging from 70 to 200 hours.

16. The process for the manufacture of an anode according to claim 13 wherein the baking temperature of the green anodes is about 1,100° C.

17. The process for the manufacture of an anode according to claim 11 wherein the step of preparing a pre-bake mixture is carried out in an electrolytic reduction vat.

18. The anode or Söderberg slurry utilized in electrolytic cells for producing primary aluminum wherein a sugar is utilized as a pre-bake coalescing agent for the production of anodes for primary aluminum and said sugar includes at least one element or characteristic listed in the table below:

| PARAMETER | RANGE | UNIT |
|---|---|---|
| Refractometric Brix | 75–83 | % |
| Pol | 37–63 | % |
| Purity | 50–75 | % |
| Reducing sugars | 3–10 | % |
| Conductive ashes | 6–10 | % |
| IMPURITIES: | | |
| Iron | 200 max. | ppm |
| Silicon | 250 max. | ppm |
| Nickel | traces | |
| Vanadium | 150 max. | ppm |
| Calcium | 200 max. | ppm |
| Sodium | 100 max. | ppm |

wherein the anode or Söderberg slurry includes a composition of approximately 50 to 70% by weight of petroleum coke, 15 to 30% by weight of anode butts, and 15 to 25% of said sugar.

19. A process for manufacturing of aluminum by using an anode in electrolytic reduction vats, said anode being an anode utilized in electrolytic cells wherein a sugar is utilized as a pre-bake coalescing agent for the production of anodes for primary aluminum and said sugar includes at least one element or characteristic listed in the table below:

| PARAMETER | RANGE | UNIT |
|---|---|---|
| Refractometric Brix | 75–83 | % |
| Pol | 37–63 | % |
| Purity | 50–75 | % |
| Reducing sugars | 3–10 | % |
| Conductive ashes | 6–10 | % |
| IMPURITIES: | | |
| Iron | 200 max. | ppm |
| Silicon | 250 max. | ppm |
| Nickel | traces | |
| Vanadium | 150 max. | ppm |
| Calcium | 200 max. | ppm |
| Sodium | 100 max. | ppm. |

20. The process for the manufacturing of aluminum according to claim 19 wherein the anode is in the form selected from the group consisting of a slurry, pressed form, compacted form and vibrocompacted form as green anode.

21. A process for manufacturing of aluminum by utilizing an anode in electrolytic reduction vats wherein said anode is manufactured by a process comprising the steps of preparing a pre-bake mixture containing petroleum coke, residual reduction anode, anode butts and sugar cane molasses, crushing sieving and classifying petroleum coke and anode butts, and hearing classified fractions in a mixture with sugar cane molasses at temperature ranging from 100° C. to 250° C.

* * * * *